US011572717B2

(12) United States Patent
Robert

(10) Patent No.: US 11,572,717 B2
(45) Date of Patent: Feb. 7, 2023

(54) MOTOR VEHICLE LOCK WITH THREE POSITIONS

(71) Applicant: U-SHIN FRANCE, Creteil (FR)

(72) Inventor: Johann Robert, Abbeville (FR)

(73) Assignee: U-SHIN FRANCE, Creteil (FR)

( * ) Notice: Subject to any disclaimer, the term of this patent is extended or adjusted under 35 U.S.C. 154(b) by 166 days.

(21) Appl. No.: 16/926,218

(22) Filed: Jul. 10, 2020

(65) Prior Publication Data

US 2020/0340277 A1 Oct. 29, 2020

Related U.S. Application Data

(63) Continuation of application No. PCT/EP2019/050587, filed on Jan. 10, 2019.

(30) Foreign Application Priority Data

Jan. 10, 2018 (EP) ..... 18151018

(51) Int. Cl.
*E05B 81/16* (2014.01)
*E05B 79/14* (2014.01)
(Continued)

(52) U.S. Cl.
CPC ..... *E05B 81/16* (2013.01); *E05B 79/14* (2013.01); *E05B 81/06* (2013.01); *E05B 81/34* (2013.01); *E05B 81/46* (2013.01)

(58) Field of Classification Search
CPC ..... E05B 81/16; E05B 81/06; E05B 81/34; E05B 81/46; E05B 79/14; E05B 79/16; E05B 81/36
See application file for complete search history.

(56) References Cited

U.S. PATENT DOCUMENTS 6,349,983 B1 * 2/2002 Dupont ..... E05B 81/14 292/216
2015/0145265 A1 5/2015 Weinerman et al.
(Continued)

FOREIGN PATENT DOCUMENTS

CN 205259746 5/2016
EP 0170577 2/1986
(Continued)

OTHER PUBLICATIONS

International Search Report for international patent application PCT/EP2019/050587, dated May 6, 2019.

*Primary Examiner* — Kristina R Fulton
*Assistant Examiner* — James E Ignaczewski
(74) *Attorney, Agent, or Firm* — Burris Law, PLLC

(57) ABSTRACT

An electric lock for a motor vehicle opening leaf includes a bolt, a pawl, a central opening lever, and an actuator with three abutment positions and capable of interacting with the central opening lever, the actuator including a driver. The driver includes a toothed driving wheel and a driven wheel. The driven wheel includes a second driving member, a motor intended for driving the actuator, a central transfer lever able to be moved by the driven wheel of the driver by the second driving member and the movement of which is capable of being transmitted to the central opening lever in order to move the pawl into its retracted angular position. One of the wheels of the driver includes a first circle-arc shaped oblong slot and the other wheel includes a first driving member extending through the first circle-arc shaped oblong slot.

13 Claims, 12 Drawing Sheets

(51) Int. Cl.

| | |
|---|---|
| ***E05B 81/06*** | (2014.01) |
| ***E05B 81/34*** | (2014.01) |
| ***E05B 81/46*** | (2014.01) |

(56) References Cited

U.S. PATENT DOCUMENTS

| | | | | |
|---|---|---|---|---|
| 2017/0328092 | A1* | 11/2017 | Im | E05B 81/34 |
| 2018/0112443 | A1* | 4/2018 | Scocco | E05B 77/36 |

FOREIGN PATENT DOCUMENTS

| | | | | |
|---|---|---|---|---|
| EP | 0170577 | A1 * | 2/1986 | E05B 47/00 |
| EP | 1035280 | | 9/2000 | |
| EP | 1234936 | | 8/2002 | |
| EP | 1234936 | A1 * | 8/2002 | E05B 81/14 |
| FR | 2783551 | | 3/2000 | |
| WO | 2012052533 | | 4/2012 | |
| WO | 2017195023 | | 11/2017 | |

* cited by examiner

MOTOR VEHICLE LOCK WITH THREE POSITIONS

CROSS-REFERENCE TO RELATED APPLICATIONS

This application is a continuation of International Application No. PCT/EP2019/050587, filed on Jan. 10, 2019, which claims priority to and the benefit of EP 1815108.1, filed on Jan. 10, 2018. The disclosures of the above applications are incorporated herein by reference.

FIELD

The present disclosure relates to an electric latch for a door leaf of a motor vehicle, in particular for a door, a hatchback, or a trunk of a motor vehicle.

BACKGROUND

The statements in this section merely provide background information related to the present disclosure and may not constitute prior art.

A motor vehicle latch is intended to be fixedly mounted on a door leaf of a motor vehicle and typically includes a pin intended to pivot, during closure, in one direction around a striker fastened on the structure of the motor vehicle in order to ensure closure of the door leaf. Opening of the door leaf is enabled by a rotation of the pin in the reverse direction. The rotation in the reverse direction during opening of the door leaf follows the displacement of the external or internal vehicle which is linked to the latch through a control means which generally acts on an opening lever in order to make the latter pivot which, in turn, releases the pin via a hooking device in the desired direction.

In the process of electrically opening a latch in normal operation, the pawl that retains the pin is driven by an electric actuator so as to release the pin. As soon as it is no longer retained by the pawl, the pin can pivot so as to release the striker. Once the electric actuator is no longer engaged with the pawl, the pawl is brought back to the pin by a spring.

In general, latches use one motor for each function. The functions may consist of lockout, super-lockout, child safety locking, so-called "cinch-in" power closure or electric opening. Thus, for locking, super-locking, child safety locking type functions, the motor is generally used through a stop-to-stop sequence in order to allow resetting the mechanical state by launching the following sequence by a reverse powering of the motor.

For power closure or electric opening type functions, the power of the motor is generally used in one single direction, often through a stop-to-stop sequence, with a return mechanism, commonly called "back-drive," allowing resetting the system for the next operation. The return movement is either ensured by the motor, or enabled by a declutching associated to a mechanical return when the current is switched off. The return operation terminates on a stop and in general no reverse power supply of the motor could be used for another function.

Using one single motor, there is known the U.S. Patent Publication No. 2015/0145265 disclosing an actuator configured to make a locking assembly switch from a closed state in which an element is locked into an open state in which the item is unlocked. A pin operational in a first position to engage a striker connected to another element of the vehicle when the locking assembly is in the closed state.

The pin in a second position enables the striker to be cleared when the locking assembly is in the open position. The actuator comprises a driver and a gear system. The gear system is operational so as to displace a release element. The release element is configured to be operationally linked to the pin so that the movement of the release element urges the pin to be displaced towards the second position. This actually consists of a latch with limited functions because of the device and the monostable nature of the actuator. This latch is intended to perform an electric opening.

There is also known the French patent publication FR 2783551 disclosing an electric latch for a door leaf of a motor vehicle, including a latch case, a first compartment of which contains a pin and a pawl, and a second compartment of which tightly contains a lockout lever adapted to set the latch in the locked-out/unlocked-out position, and an electric motor for powering the opening, characterized by the fact that, in the second compartment, the electric motor is adapted to rotatably drive, through a gear train, a toothed wheel provided with at least one radially eccentric crankpin, the crankpin being intended, during the rotation of the wheel, to drive a control lever until a radially eccentric pin on the wheel comes into contact with an elastic opening end-of-stroke stop, the electric power supply of the motor being time-programmed for a period that is long enough to ensure that the pin reaches the elastic stop, the control lever being rotatably linked with an opening lever arranged within the first compartment and adapted to cooperate with the pawl so as to displace it into the pin release position. This disclosure shows a latch with one motor for the electric opening and one motor for the locking/unlocking, and thus having a compactness that is likely to be improved. Furthermore, in order to determine the position of the actuator, contactors or buttons supply the electronic control unit with information.

Furthermore, there is also known the European patent publication EP 1035280 A disclosing an electrically-actuated latch for a door of a motor vehicle, provided with a locking unit, a control unit which may be connected to corresponding manual control members associated to the door and capable of interacting with the locking unit to open it, first and second deactivation means which may be selectively activated to deactivate the opening of the locking unit from inside and outside the vehicle respectively, and an electric actuator having an output element movable from a rest position along a first stroke so as to cause opening of the locking unit and according to a second stroke, different from the first pathway, so as to selectively activate the first blocking means. Thus, this application discloses a middle spring-biased double-return latch enabled by an oversized motor in order to overcome the force of the springs during the functional strokes, the latch uses two motors altogether. Furthermore, at least one of the end-of-stroke positions is not stable and finally this latch is still likely to gain in compactness.

Thus, the prior art uses several motors to enable access to different functions or just one actuator which may adopt two positions thereby limiting the functions of the associated latches. There are latches with one motor that are adapted to offer several functions, nevertheless, in order to use the same motor for several different operations, these latches should be equipped with micro-switches, and the electronic control unit must stop the power supply accordingly, so that another stroke is available to offer another function. Hence, the actuator is controlled by sending instructions at each stoppage in a sequential and seldom repeatable manner.

When such a sequential gesture is used, the repeatability of the operation is poor, because it depends on the responsiveness of the system and on the inertia of the latter. Usually, a latch should be provided with an independent embedded electronic management, so as not to rely on the central unit of the vehicle in order to gain in responsiveness. All this overfills the latch as a whole and does not facilitate the integration of backup batteries for the "off" operation in case of maintenance or insufficient battery charge of the car for example.

SUMMARY

This section provides a general summary of the disclosure and is not a comprehensive disclosure of its full scope or all of its features.

The present disclosure provides a latch with improved compactness, versatility, motorization, and assembly elements savings.

The latch according to a form of the present disclosure comprises an electric latch for a door leaf of a motor vehicle comprising: a pin adapted to pivot about its axis between a striker catch angular position and a striker release position, a pawl adapted to pivot about its axis between a locking angular position in which the pawl is prone to cooperate in abutment with a sear of the pin so as to retain the pin in the striker catch position and a stowed angular position in which the pin is free to rotate about its axis, an opening central lever, the lever bearing on the pawl and adapted to displace the pawl in its stowed angular position, and an actuator intended to occupy three stop positions and adapted to cooperate with the opening central lever. The actuator includes a driver including a driving toothed wheel and driven wheel, the driving toothed wheel being adapted to rotatably drive the driven wheel by a first drive member and the driven wheel including a second drive member, a motor intended to rotatably drive the driving toothed wheel of the driver by a worm screw, and a transfer central lever adapted to be displaced by the driven wheel of the driver by the second drive member and whose movement is adapted to be transmitted to the opening central lever so as to displace the pawl into its stowed angular position. One amongst the wheels of the driver includes a first circle-arc shaped oblong slot and the other wheel includes a first drive member extending through the first circle-arc shaped oblong slot, the driver being adapted to perform a rotating stroke of a wheel without rotatably driving the other wheel.

In at least one form, the latch according to the present disclosure is such that the first drive member is a crankpin belonging to the driven wheel and extending perpendicularly with respect to one of the two main faces of the driven wheel through the first circle-arc shaped oblong slot of the driving toothed wheel, the crankpin being radially eccentric and the first circle-arc shaped oblong slot allowing for a rotating idle stroke of the driving toothed wheel before driving by bearing the driven wheel. This facilitates the drive and allows for a slot/drive element shape-matching while reducing the possibility of a radial backlash especially when the crankpin has the same diameter as the width of the oblong slot.

In one form, the latch according to the present disclosure is such that the second drive member of the driven wheel is a crankpin extending perpendicularly through a recess having a shape matching with the transfer central lever so as to displace by bearing the transfer central lever, the crankpin being radially eccentric. This facilitates the drive of the transfer central lever and the larger the eccentricity the shorter the stroke to sufficiently displace the transfer central lever will be.

In yet another form, the latch according to the present disclosure further comprises a case within which lies the driver and on which is fastened a stop device equipped with two stops, and in that one amongst the wheels of the driver includes a stop axial protrusion adapted to rotatably move between the two stops between two positions called first and third stop positions. Sealing allows the latch to be isolated from dust or liquid that might freeze and alter the mechanism. The stops allow stopping the rotation of the motor in a determined position without resorting to contactors.

Optionally, the latch according to the present disclosure comprises an interface set adapted to cooperate with the opening central lever so as to displace the pawl into its stowed angular position and including a release lever adapted to pivot about its axis so as to displace the pawl between a pin retaining angular position and a striker release stowed position, the release lever including a linking device adapted to receive a device for displacing the release lever such as a cable or a control-rod.

This provides the latch with a new function of displacing the pawl by a device other than the transfer central lever. Furthermore, this opens up the possibility of setting a child safety by declutching the release lever and vice versa.

In another form, the latch according to the present disclosure is such that the transfer central lever is adapted to be displaced by translation in a plane perpendicular to the axis, the lever comprising a second oblong slot extending in the direction of translation of the transfer central lever, the release lever comprises a third oblong slot extending in the direction of translation of the transfer central lever, the latch further comprises a clutch and declutch (clutch/declutch) intermediate lever between the transfer central lever and the release lever, the clutch/declutch intermediate lever including two protrusions extending substantially perpendicularly with respect to the plane of the lever, the first protrusion extending through the second oblong slot and the second protrusion projecting through the third oblong slot, the opening central lever includes a contact protrusion adapted to be driven in abutment by the second protrusion projecting through the third oblong slot, so that the translational displacement of the transfer central lever is adapted to displace the second protrusion of the clutch/declutch intermediate lever between a position where the surface is unable to rotatably drive the opening central lever and a position where the rotation of the release lever by the displacement device causes the displacement of the opening central lever by abutting contact with the contact protrusion of the opening central lever.

This improves the new function of the latch for displacing the pawl by a device other than the transfer central lever.

Furthermore, this opens up the possibility of setting a child safety by declutching the release lever and vice versa. Moreover, the declutching possibility allows removal of an inertial system.

In at least one form of the present disclosure, the transfer central lever further comprises an elastic biasing device of the clutch/declutch intermediate lever bearing on the first protrusion, the elastic biasing device being adapted to bias the clutch/declutch intermediate lever towards its initial position non-biased by the transfer central lever. This mechanically resets the actuator once this function is used.

Another improvement provided by the present disclosure is obtained when the pawl of the latch according to the present disclosure includes two radial protrusions extending over two distinct planes perpendicular to the axis of rotation of the pawl, the first protrusion having a surface adapted to be driven by the opening central lever and the second protrusion having a surface adapted to cooperate in abutment with a sear of the pin so as to retain the pin in the striker release position. This allows for a gain in compactness because as the two arms of the pawl are on two different planes, it is possible to dispose the opening central lever and the pin opposite one another and on two parallel planes.

In a form of the present disclosure, the latch according to the present disclosure is such that, the latch comprises a rocker lever having two opposite arms, the rocker lever being adapted to pivot about its axis and the transfer central lever comprising a stop wall adapted to interface with a first arm of the rocker lever. The rocker lever being adapted to pivot between an angular position in which the first arm comes into abutting contact with an active surface of the stop wall so as to block the transfer central lever in the position of displacement of the pawl in its stowed angular position, and an angular position cleared with respect to the stroke of the transfer central lever in which the first arm of the rocker lever is away from the stop wall so as to enable the return of the pawl back in its locking angular position.

This adds to the present disclosure the possibility of immobilizing the pawl in its pin release position, while enabling a return into the intermediate position of the actuator, by the oblong slot of the actuator linked to the motor. The actuator is reset and a new stroke is possible by rotating the motor in the other direction.

In another form, the latch according to the present disclosure is such that it comprises an elastic biasing device of the rocker lever adapted to bias the rocker lever in its angular position of blocking the transfer central lever.

Yet another improvement provided by the present disclosure is obtained when the latch comprises a rocker lever pawl adapted to pivot about the same axis as the pin between a position in which it holds the rocker lever in its angular position of blocking the transfer central lever in the position of displacement of the pawl in its stowed angular position, and a position in which it enables a return of the rocker lever in its angular position cleared with respect to the stroke of the transfer central lever. The latch also comprises an elastic biasing device of the rocker lever pawl adapted to bias the rocker lever pawl towards its position of holding the rocker lever in its angular position of blocking the transfer central lever, a pin touch-probe adapted to pivot about the same axis as the pin, the pin touch-probe, and the pin being rotatably linked, where radial surfaces belonging respectively to the pawl of the rocker lever and to the pin touch-probe and one end of the rocker lever such as the end of the rocker lever is adapted to rest successively on the radial surfaces when the pin is rotatably driven towards its striker release angular position.

This enables blocking of the transfer central lever in the position of displacement of the pawl in its stowed angular position through a locking of the rocker lever, besides, the continuity of the surfaces allows remaining in the blocking position even during the door closure process during which the pin rotates so as to catch a striker.

In an advantageous form, the latch according to the present disclosure is such that the pin touch-probe includes a notch having a shape matching with the end of the rocker lever, in order to hold the rocker lever in its angular position cleared with respect to the stroke of the transfer central lever.

In yet another form of the present disclosure, the actuator is adapted to occupy three stop positions the first stop position being defined by the contact of the stop axial protrusion on one of the stops when the motor rotates in one direction, the second stop position being an intermediate position of the stop axial protrusion on one stop of the first circle-arc shaped oblong slot when the motor rotates in the other direction, and the third stop position being defined by the contact of the stop axial protrusion on the other stop. This enables an improved use of the three stop positions of the latch according to the present disclosure.

In order to improve compactness, in some forms of the present disclosure, all of the axes of rotation of the pin, of the pawl, of the release lever, and of the rocker lever are parallel to one another.

In one form of the present disclosure, the radius of the rocker lever pawl is larger than that of the pin touch-probe.

In another advantageous form, the latch according to the present disclosure comprises one single motor. This allows carrying out many functions with one single power supply thereby allowing for a saving in terms of assembly and an improvement of the motor and a simplification of the kinematics.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which:

FIG. 1*a* to FIG. 1*d* are views according to several angles of the latch, according to the present disclosure, in the striker (not represented) catch position;

FIG. 2 is a perspective view of the latch, according to the present disclosure;

FIG. 3*a* to FIG. 3*c* are perspective views of the driver, according to the present disclosure, illustrating the driving wheel and the driven wheel;

FIG. 3*d* is a perspective view of the driven wheel, according to the present disclosure;

FIG. 3*e* is a perspective view of the non-toothed portion of the driving wheel, according to the present disclosure;

Figure 13:
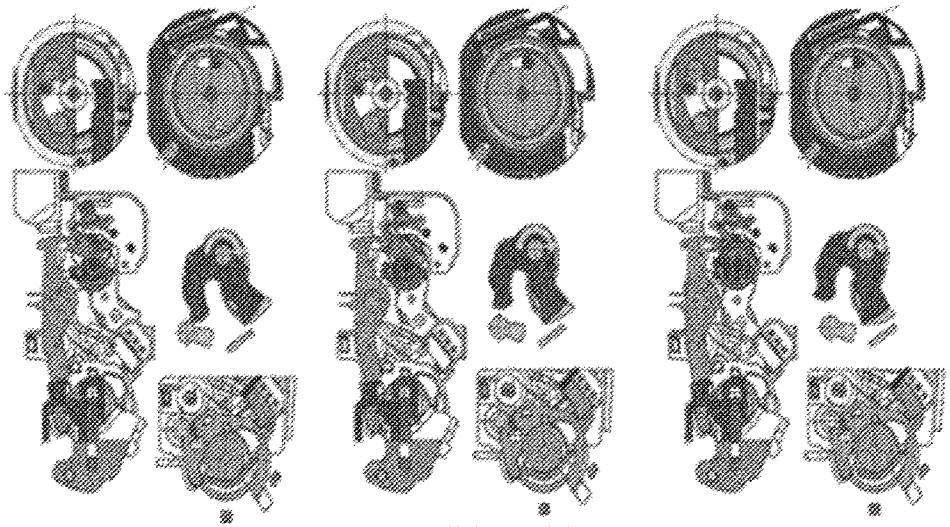
Figure 14:
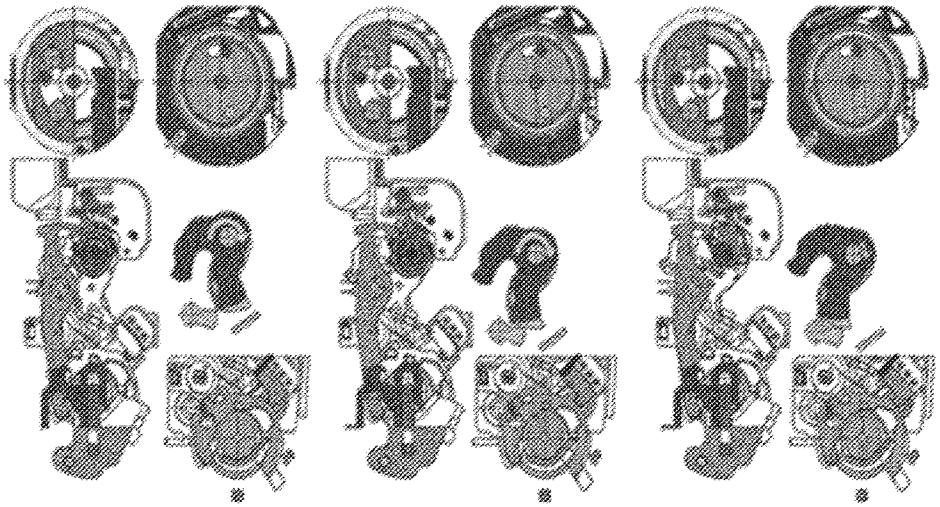
Figure 15:
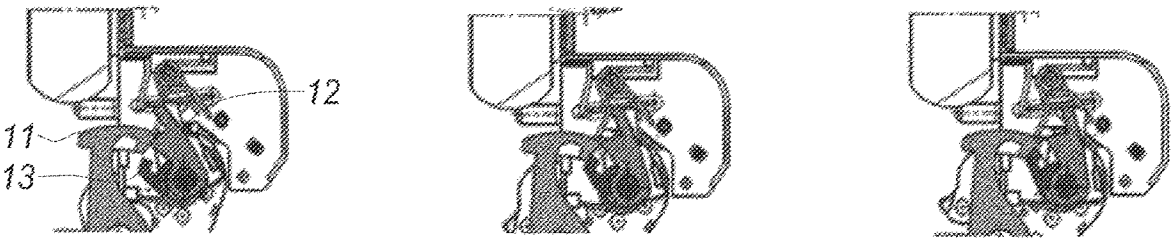
Figure 16:
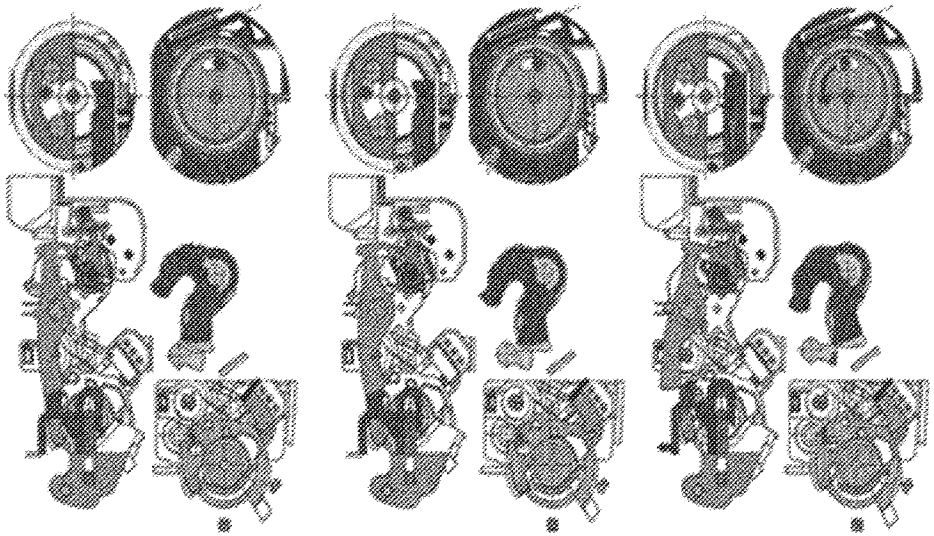
Figure 16:
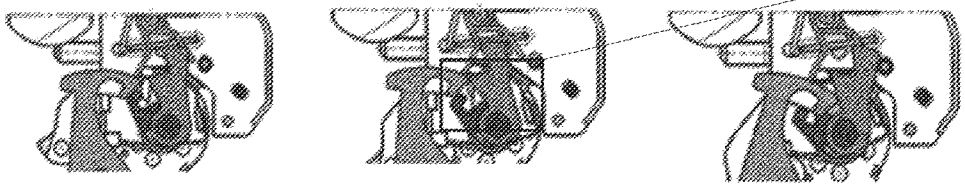
Figure 16A:
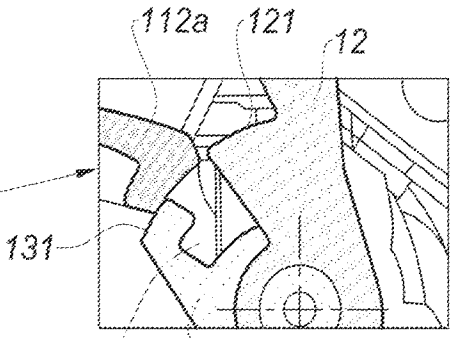
Figure 17:
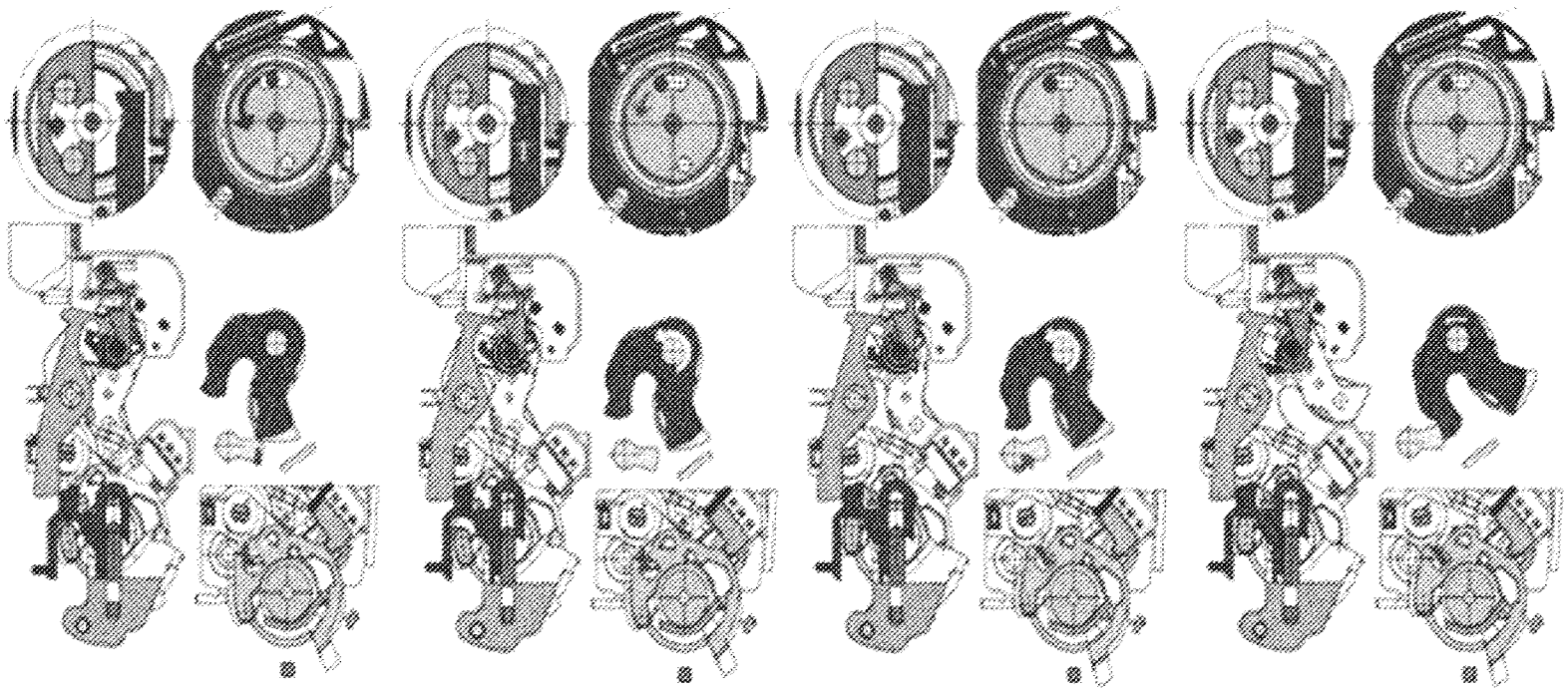
Figure 18:
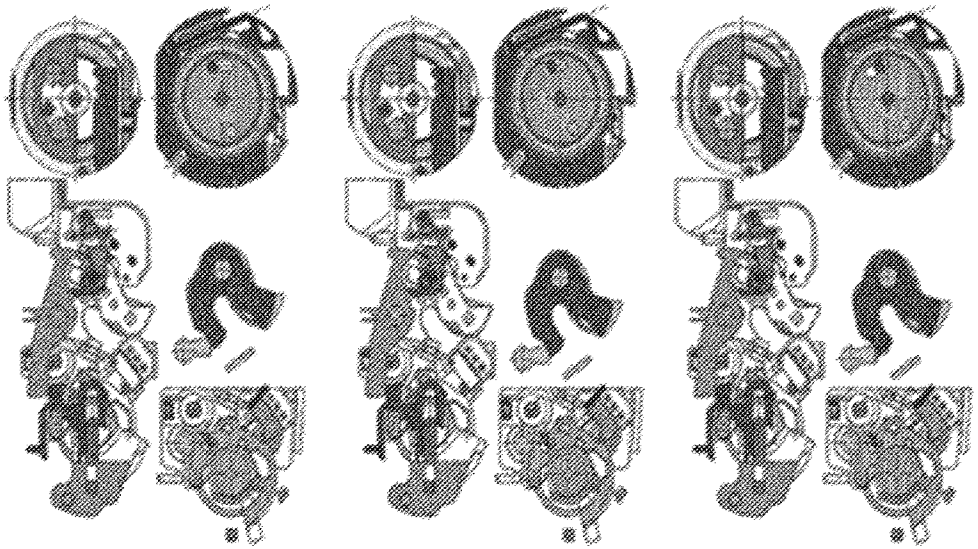
Figure 19:
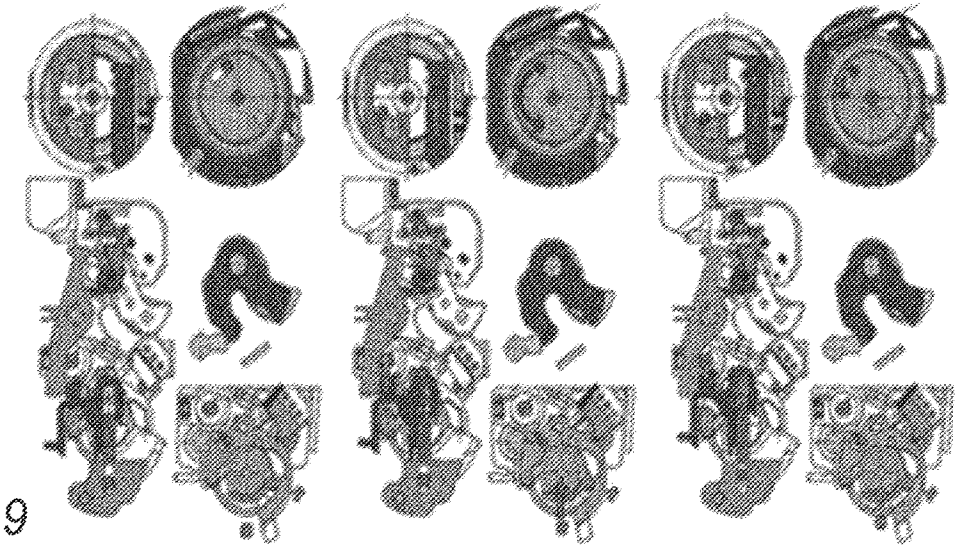
Figure 20B:
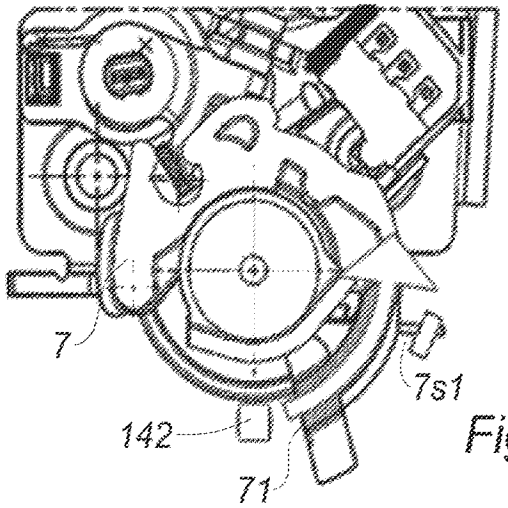
Figure 22:
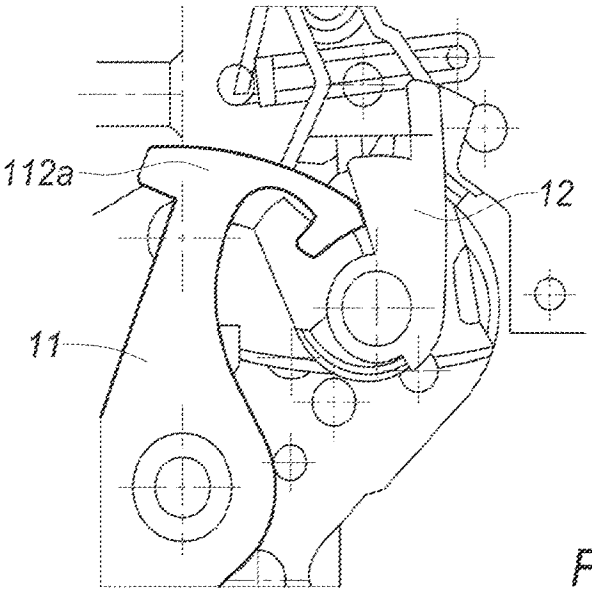
Figure 20A:
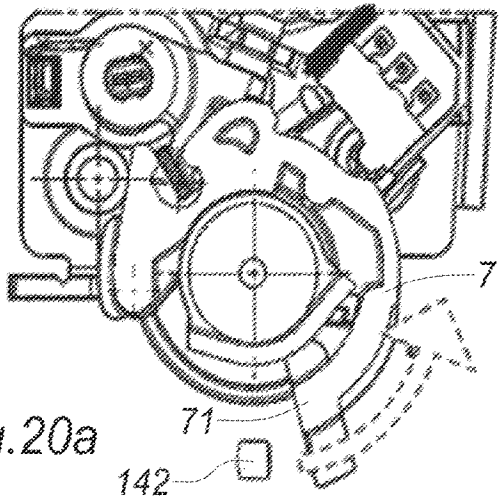
Figure 21:
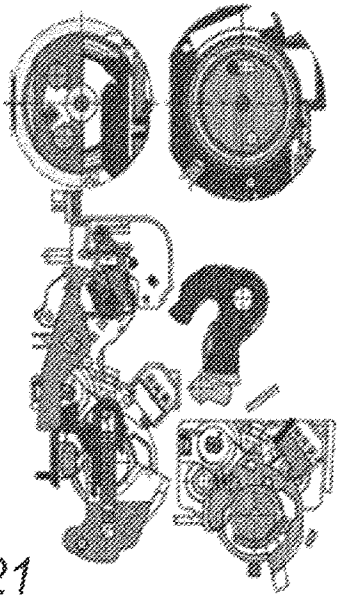
Figure 23:
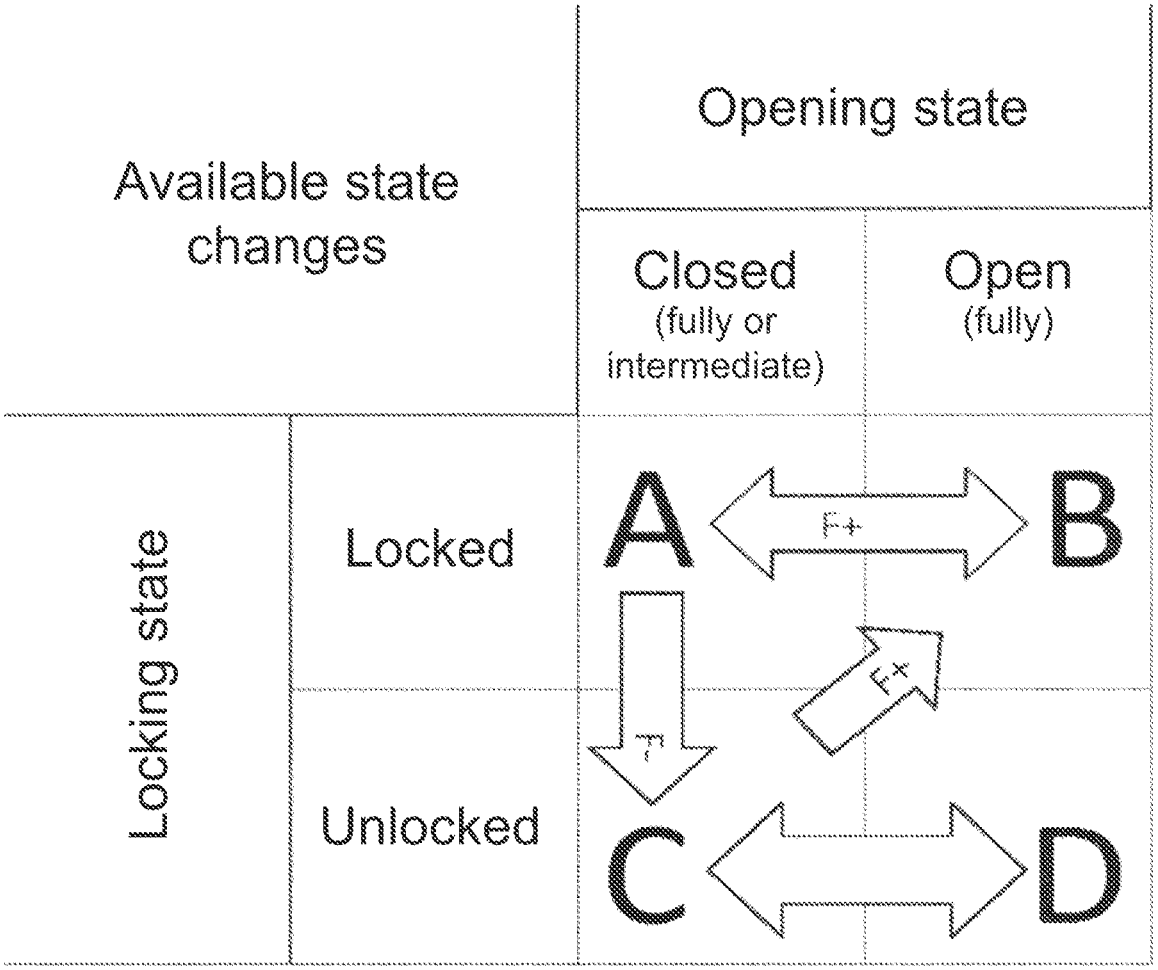

FIG. 13 and FIG. 14 successively illustrate the kinematics of the pawl of the rocker lever and of the pin touch-probe, according to the present disclosure, towards a striker release;

FIG. 15 is a plan view similar to FIG. 14 centered on the rocker lever, the pawl of the rocker lever and the pin touch-probe, according to the present disclosure;

FIG. 16 is a plan view of the kinematics of the latch, according to the present disclosure, during the process of catching the striker and setting the rocker lever in the cleared angular position;

FIG. 16*a* is a detail view of FIG. 16 centered on the rocker lever, the pawl of the rocker lever and the pin touch-probe;

FIG. 17 illustrates the kinematics of the return of the pawl in the locking position towards the intermediate stop position of the actuator, according to the present disclosure;

FIG. 18 and FIG. 19 successively illustrate the kinematics of the second function of the latch, according to the present disclosure, the actuator moving towards the third stop position;

FIG. 20*a* and FIG. 20*b* illustrate the clutch/declutch intermediate lever respectively in the declutched and clutched positions, according to the present disclosure;

FIG. 21 is a plan view of the latch, according to the present disclosure, in the clutched position of the clutch/declutch intermediate lever in the third stop position;

FIG. 22 is a plan view of the rocker lever in the position held cleared with respect to the stroke of the transfer central lever, according to the present disclosure; and FIG. 23 illustrates all of the functions that are possible thanks to the latch, according to the present disclosure.

In all of FIGS. 1 to 23, identical elements bear the same reference numerals.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Throughout the following description, different elements of the latch according to the present disclosure are illustrated and described through an example which is non-limiting with regards to the scope of the present disclosure.

FIGS. 1*a* to 1*d* represent different elements of the same electric latch according to the present disclosure for a door leaf of a motor vehicle in different perspectives.

In these figures, the electric latch S includes a pivoting pin 10 intended to cooperate with a striker (not represented) and as such not being part of the present disclosure. In one form, the pin 10 has a fork-like shape delimiting a notch 20 adapted to receive a striker 19. In the closed position of the latch S, the pin 10 is blocked in rotation by a pivoting pawl 9, inhibiting the rotation of the pin 10. The pawl 9 is linked in rotation with an opening central lever 7 whose pivoting is driven by an actuator A1 for opening the latch. It should be noted that, in the latch according to the present disclosure, the pawl 9 is in one form associated to a spring 9*s* (not represented) type biasing device to bias the pawl 9 towards the locking angular position.

Furthermore, the pin 10 is adapted to rotate about an axis of rotation R1 parallel to the axis of rotation R2 of the pawl 9. In turn, the opening central lever 7 is also adapted to rotate about an axis of rotation R3 parallel to R1 and R2. This allows improving the compactness of the latch according to the present disclosure. This compactness is improved by the possibility of assembling the parts on different planes thanks to the pawl 9 having two radial protrusions 91 and 92 extending over two distinct planes perpendicular to the axis R2 of rotation of the pawl 9, the first radial protrusion 91 having a surface adapted to be driven by the opening central lever 7 and the second protrusion 92 having a surface adapted to cooperate in abutment with the pin 10 so as to retain the pin 10 in the striker catch angular position (not represented and not being part of the present disclosure).

The driver E of the latch according to the present disclosure is rotatably driven by a motor 1 and worm screw 3 assembly that are known per se. The motor can make the worm screw rotate in both possible directions of rotation. The rotation of the worm screw makes the driving toothed wheel 2 rotate. Which wheel is adapted to make the driven wheel 5 rotate which includes the crankpins 5*c* and 5*d*. By rotating, the crankpin 5*b* is adapted to displace in translation the transfer central lever and the crankpin 5*c* diametrically opposite to the crankpin 5*b* on the same face of the driven wheel 5 is adapted to be displaced angularly between two stops lying in a stop device 18 fastened to the case of the latch according to the present disclosure.

Figure 1A:
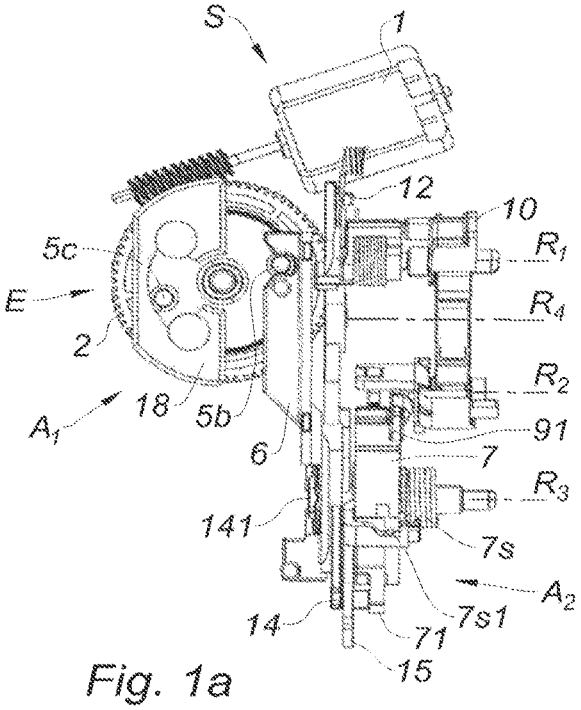
Figure 1B:
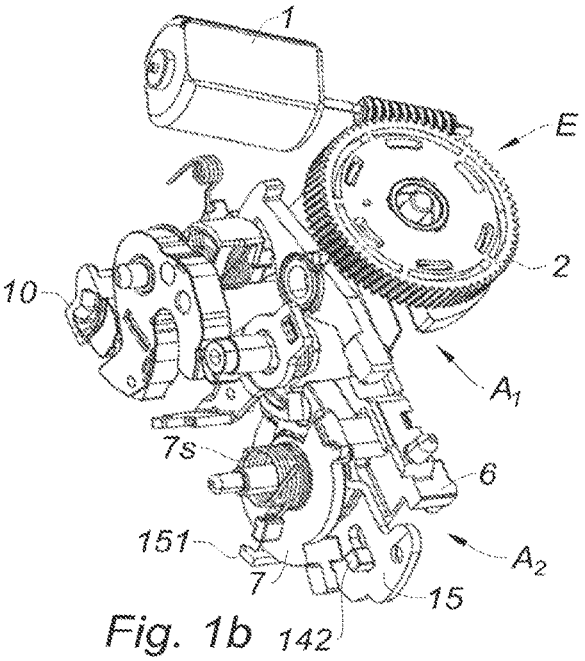
Figure 1C:
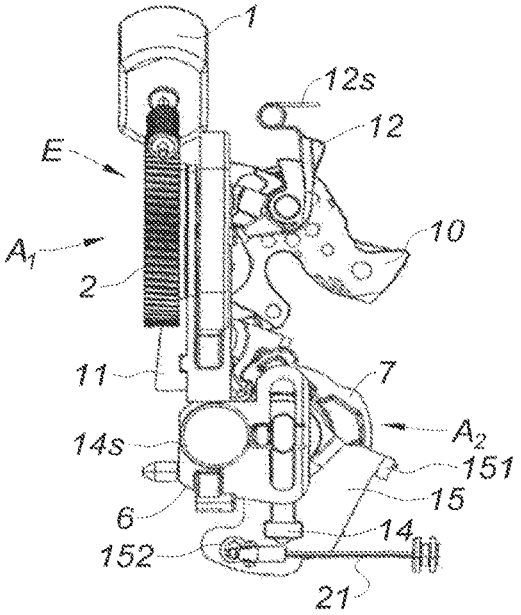
Figure 1D:
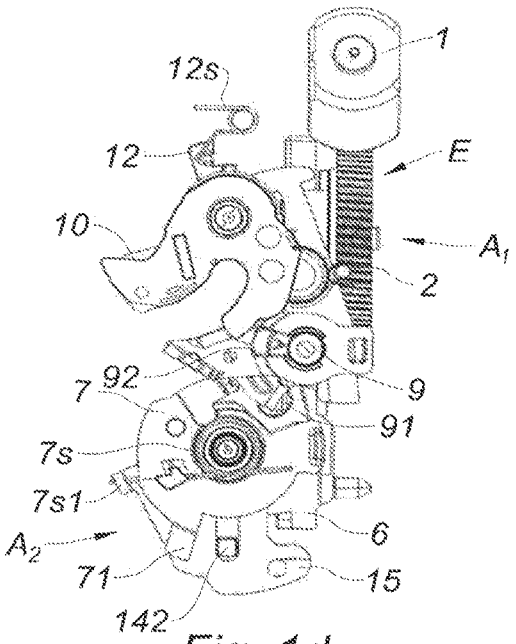

The latch according to the present disclosure illustrated in FIGS. 1*a* to 1*d* also shows an interface set A2 adapted A2 adapted to cooperate with the opening central lever 7 so as to displace the pawl 9 into its stowed angular position. The interface set A2 is defined by the cable (or control-rod) associated to the release lever. This interface set A2 enables a connection with a cable or a control-rod which, in turn, are connected to an internal or external handle. Associated to the interface set, there is an elastic biasing device 7*s* of the opening central lever 7 one end 7*s*1 of which rests on the stud 151 of the release lever 15 so as to bias the release lever 15 towards its initial position after displacement of the pawl 9 into its stowed position. FIGS. 1*b*, 1*c* and 1*d* show a release lever 15 adapted to pivot about its axis R3 (FIG. 1*a*) so as to displace the pawl 9 between a pin 10 retaining angular position and a striker release stowed position (not represented) and comprising a stud 151, the release lever 15 including a linking device 152 adapted to receive a device 21 for displacing the release lever 15 such as a cable or a control-rod.

It should be noted that the linking device 152 may be linked to a door internal handle or an external handle. The two handles may be at the front or at the rear of a vehicle.

In FIG. 1*b*, it is possible to distinguish an elastic biasing device 7*s* of the opening central lever 7 whose end 7*s*1 (FIG. 1*d*) rests on a stud 151 of the release lever 15 in the rest position so as to bias the release lever 15 towards its initial position after displacement of the pawl 9 in its stowed position.

FIGS. 1*c* and 1*d* illustrate the latch S according to the present disclosure and show a clutch/declutch intermediate lever 14 which is located between the transfer central lever 6 and the release lever 15. This clutch/declutch intermediate lever 14 includes two protrusions 141 (FIG. 1*a*) and 142 (FIG. 1*d*) which extend perpendicularly with respect to the plane of the clutch/declutch intermediate lever 14 which is the plane of FIGS. 1*c* and 1*d*.

Figure 2:
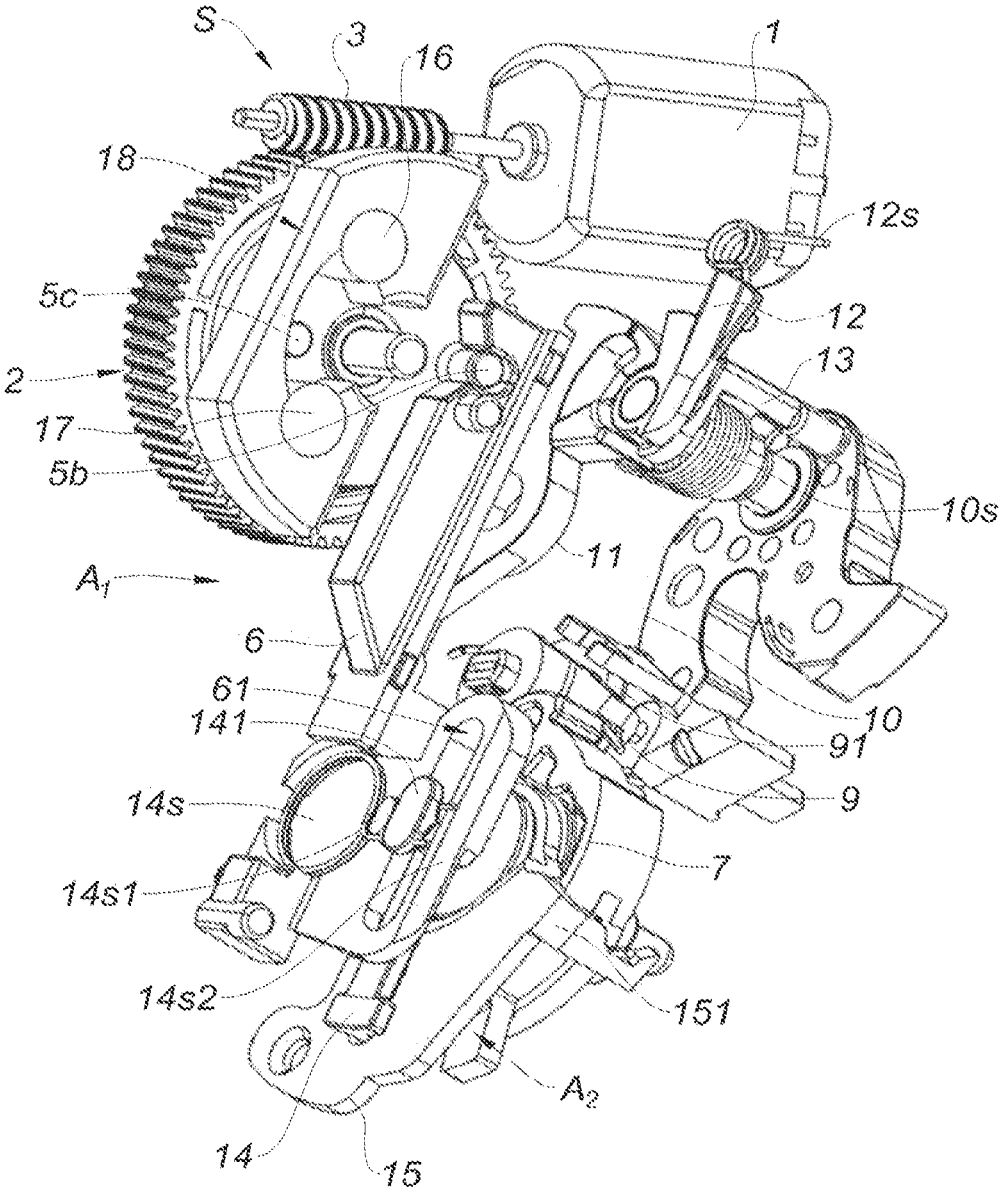

Referring to FIG. 2, the first protrusion 141 extends through an oblong slot 61 belonging to the transfer central lever 6 and the second protrusion 142 (FIGS. 1*d* and 1*b*) projects through a third oblong slot 153 belonging to the release lever 15.

In this same FIG. 2, it is possible to distinguish a spring 14*s* of the clutch/declutch intermediate lever 14 bearing on either side of the first protrusion 141, the spring 14*s* is adapted to bias the clutch/declutch intermediate lever 14 towards its initial position non-biased by the transfer central lever 6. Indeed, since the two legs 14*s*1 and 14*s*2 bear on two sides of the first protrusion 141 of the clutch/declutch intermediate lever 14, following a displacement, the clutch/declutch intermediate lever 14 is subjected to biasing force towards its initial position.

Furthermore, in FIG. 2, the elements of the stop device 18 are shown. This stop device includes two stops 16 and 17 between which the crankpin 5*c* of the driven wheel 5 could be displaced.

Figure 3C:
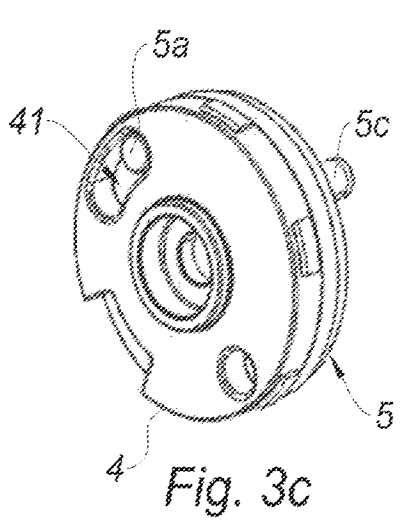
Figure 3B:
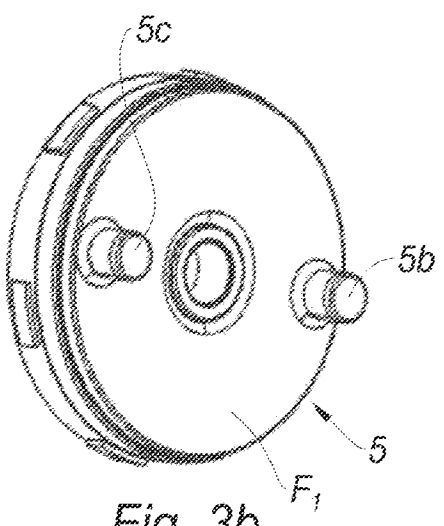
Figure 3A:
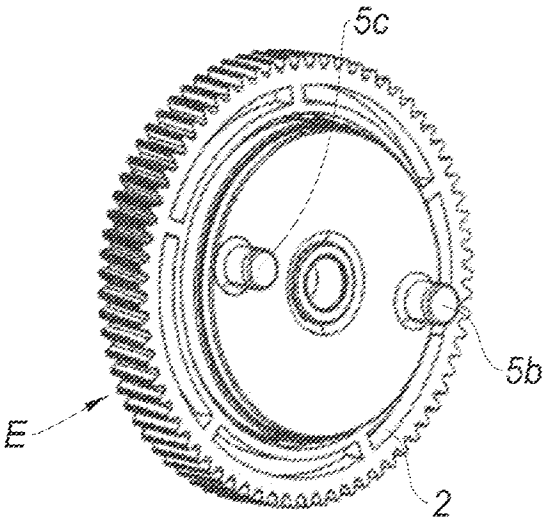
Figure 3E:
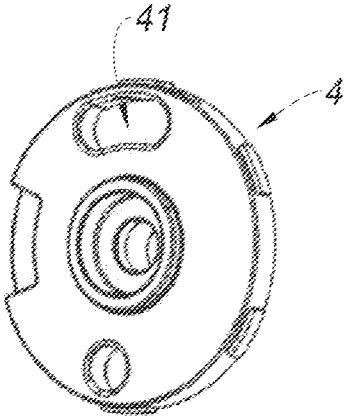

FIGS. 3*a* to 3*c* show the driver E of the latch according to the present disclosure. It should be noted that the driving toothed wheel 2 comprises a part including teeth at the periphery thereof and a first circle-arc shaped oblong slot 41 thereinside or of several parts, the disk 4 including the first circle-arc shaped oblong slot 41 (FIG. 3*c*). By making it in one single part, time is saved during mounting and therefore one step of the manufacturing process, by making it into several parts, it is possible to add sub-functions.

The driven wheel 5 illustrated in FIG. 3*b* is rotatably driven by the driving toothed wheel 2, it includes a crankpin 5*a* which extends through the first circle-arc shaped oblong slot 41 of the driving toothed wheel 2, the driving toothed wheel 2 is adapted to perform a rotation out of sync with the driven wheel 5. In FIG. 3*b*, there are shown the two crankpins 5*b* and 5*c* serving respectively to displace (5*b*) the transfer central lever 6 and the stop crankpin (5*c*) adapted to rotatably move between the two stops 16, 17 so as to define the first and third stop positions of the latch according to the present disclosure.

FIG. 3*c* shows the end of the crankpin 5*a* extending perpendicularly on the face opposite to those of the crankpins 5*b* and 5*c* of the driven wheel 5. The first face being shown in FIG. 2*b* and the second one in FIG. 3*d*.

Figure 3D:
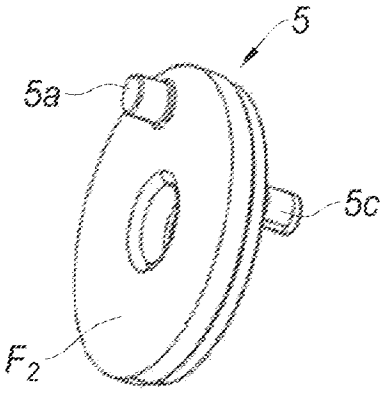

This same FIG. 3*d* illustrates the face F2 of the driven wheel 5, the face F1 shown in FIG. 3*b*. There is shown the crankpin 5*a* and the crankpin 5*c* extending in diametrically opposite directions. The extension of the crankpin is made through the first circle-arc shaped oblong slot 41 of the disk 4 which may be coincident with the driven toothed wheel 2 so as to form one single part.

Figure 4:
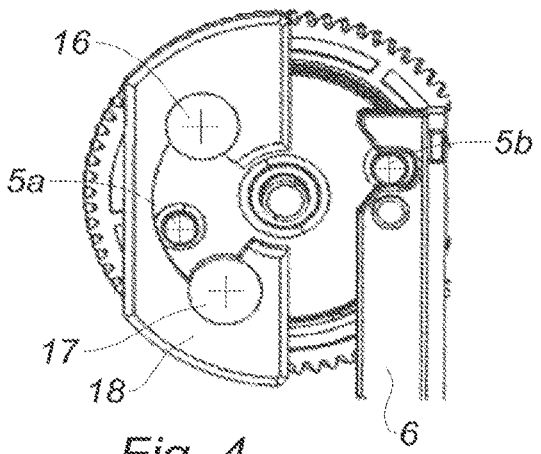
FIG. 4 is a front plan view of the driver, according to the present disclosure, with the stops and the transfer central lever.

FIG. 4 allows clearly distinguishing the stops 16 and 17 of the stop device 18 that may be fastened on the case of the latch according to the present disclosure. There is also shown the crankpin 5*c* adapted to be displaced between the stops 16 and 17, thereby defining the displacement of the transfer central lever 6 which is secured to the crankpin 5*b* belonging to the driven wheel 5.

Hence, a rotation in a clockwise or trigonometric direction of the driven wheel in FIG. 4 would make the transfer central lever 6 descend and an anticlockwise rotation would make it rise. Both rotations in opposite directions being done within the limits imposed by the stops 16 and 17. This defines the first and third stable stop positions. In the figure, the intermediate position is the second stable stop position.

Figure 5:
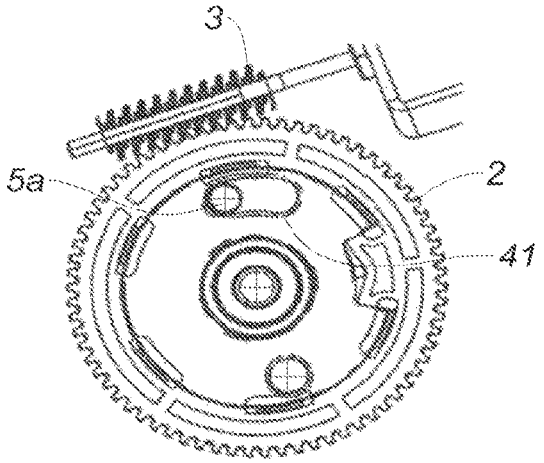
FIG. 5 is a rear plan view similar to FIG. 4 illustrating the circle-arc shaped slot, according to the present disclosure.

FIG. 5 shows the same view as FIG. 4 but from the other side. It is possible to distinguish the worm screw 3 which rotatably drives the driving toothed wheel 2 as well as the first circle-arc shaped oblong slot 41.

Figure 6:
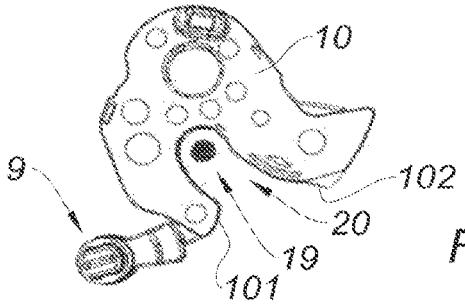
FIG. 6 is a plan view of the pawl and of the pin, according to the present disclosure, in the striker catch position.

FIG. 6 shows a pin 10 having a fork-like shape delimiting a notch 20 adapted to receive a striker 19. It is also possible to distinguish the pawl 9 prone to cooperate in abutment with a sear 101 or 102 of the pin 10 so as to retain the pin 10 in the striker 19 catch position in the notch 20.

Figure 7:
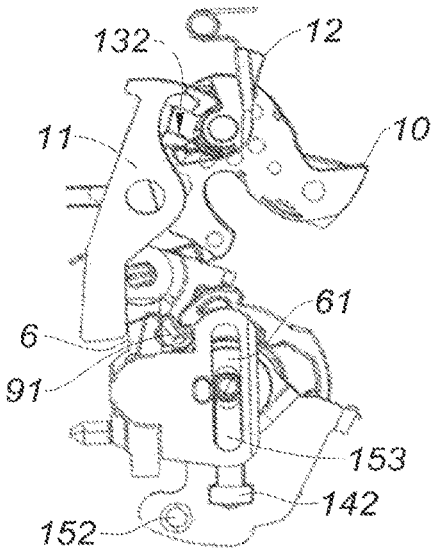
FIG. 7 is a plan view of the actuator of the latch, according to the present disclosure, where the rocker lever is in the angular position cleared with respect to the stroke of the transfer central lever.

In FIG. 7, there is clearly shown a rocker lever 11 adapted to pivot about its axis R4 (cf. FIG. 1*a*) between an angular position in which the rocker lever comes into abutting contact with an active surface of the transfer central lever 6 so as to block the latter in the position of displacement of the pawl 9 in the stowed angular position, and an angular position cleared with respect to the stroke of the transfer central lever 6 so as to enable the return of the pawl 9 back in its locking angular position when the transfer central lever 6 rises towards its initial position.

In this same FIG. 7, there is shown a pawl 12 of the rocker lever 11 adapted to pivot about its axis R5 slightly offset with respect to the axis R1 between a position in which it holds the rocker lever 11 in its angular position of blocking the transfer central lever 6 in the position of displacement of the pawl 9 in the stowed angular position, and a position in which it enables a return of the rocker lever 11 back in its angular position cleared with respect to the stroke of the transfer central lever 6.

The latch according to the present disclosure also includes a pin touch-probe 13 adapted to pivot about the same axis R1 as the pin 10. The pin touch-probe 13, and the pin 10 are rotatably linked. A complementary notch 132 is provided inside the pin touch-probe 13 in order to enable a complete rotation of the pin without interfering with the rocker lever 11 in the cleared position in the case of a mechanical opening of the latch S.

Figure 8:
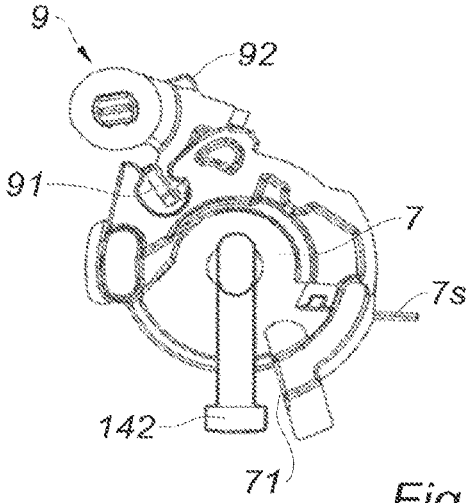
FIG. 8 is a plan view of the opening central lever and of the clutch/declutch intermediate lever in the declutched position, according to the present disclosure.

FIG. 8 illustrates the interface set A2 of the latch according to the present disclosure (also cf. FIG. 1*a*-1*d*). In FIG. 8, there is shown an opening central lever 7 which includes a contact protrusion 71 adapted to be driven in abutment by the second protrusion 142 of the clutch/declutch intermediate lever 14 projecting through the third oblong slot 153 (FIG. 7), so that the translational displacement of the transfer central lever 6 is adapted to displace the second protrusion 142 of the clutch/declutch intermediate lever 14 between a position where the second protrusion 142 is unable to rotatably drive the opening central lever 7 and a position where the rotation of the release lever 15 by the displacement device 21 (FIGS. 1*c* and 7) causes the displacement of the opening central lever 7 by abutting contact with the contact protrusion 71 of the opening central lever 7. This point is illustrated in more detail in FIGS. 20*a* and 20*b* where there is shown the rod clutch.

Figure 10:
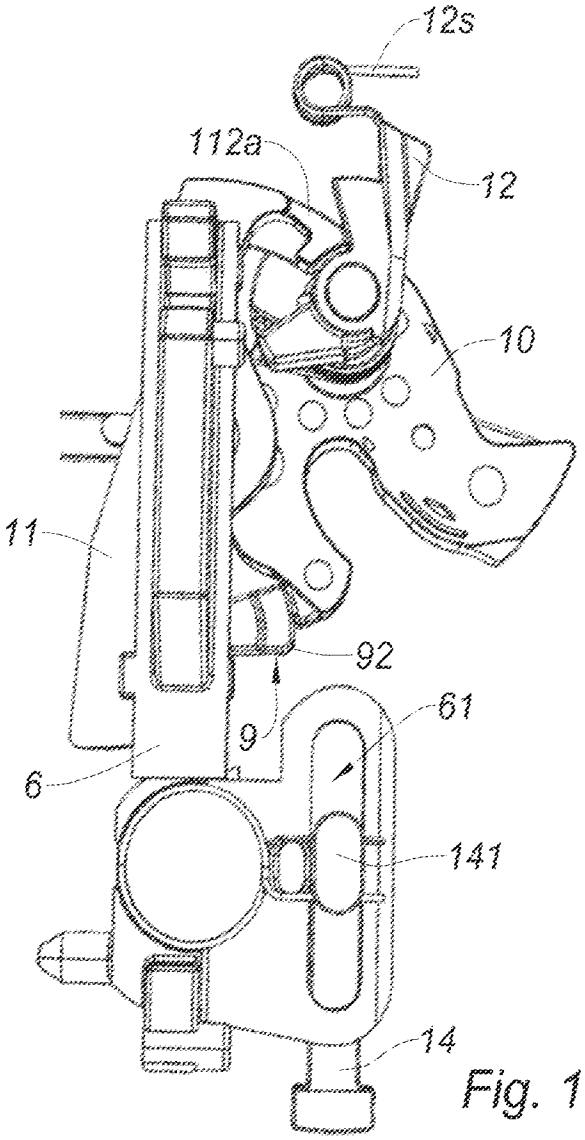
FIG. 9 and FIG. 10 are respectively front and rear perspective views of the latch, according to the present disclosure.
Figure 9:
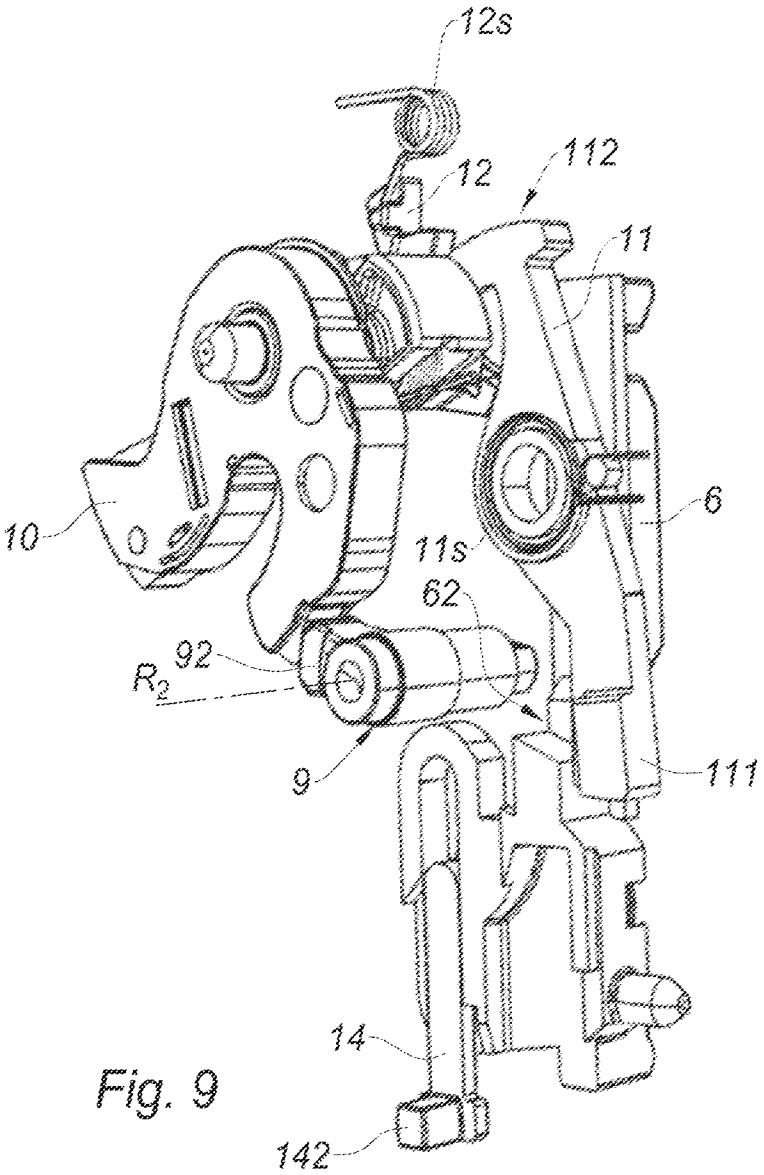

Both FIGS. 9 and 10 illustrate the latch according to the present disclosure while hiding the interface set for clarity. In these figures, it is shown that this example of the latch according to the present disclosure has a rocker lever 11 having two opposite arms 111 and 112. The rocker lever 11 is adapted to pivot about its axis R4 (cf. FIG. 1*a*) and it may be associated to a spring 11*s* type biasing device which bias it towards its angular position of blocking the transfer central lever 6 in the position of displacement of the pawl 9 in the stowed angular position.

In FIG. 9, the transfer central lever 6 comprises a stop wall 62 adapted to receive a first arm 111 of the rocker lever 11. The rocker lever 11 is adapted to pivot between an angular position in which the first arm 111 comes into abutting contact with an active surface of the stop wall 62 so as to block the transfer central lever 6 in the position of displacement of the pawl 9 in its stowed angular position, and an angular position cleared with respect to the stroke of the transfer central lever 6 in which the first arm 111 of the rocker lever 11 is away from the stop wall 62 so as to enable the return of the pawl 9 back in its locking angular position.

The biasing spring 11*s* is optional. It may be simply considered to provide the stop wall 62 with a ramp having a shape matching with the end of the first arm 111 and adapted to cause a slipping towards the angular position cleared with respect to the stroke of the transfer central lever 6.

FIG. 10 shows an end 112*a* adapted to be caught within a complementary notch 132 (cf. FIG. 7) provided inside the pin touch-probe 13 so as to enable a complete rotation of the pin without interfering with the rocker lever 11 in the cleared position in the case of a mechanical opening of the latch S. This is illustrated in FIG. 22.

In FIG. 10, it is possible to clearly distinguish the first protrusion 141 of the clutch/declutch intermediate lever 14 which extends through the oblong slot 61 belonging to the transfer central lever 6.

FIGS. 11 to 19 describe kinematics that will be detailed in the second part of the description of this example of a multifunction latch according to the present disclosure.

FIGS. 20 and 20*b* illustrate the interface set A2 of the latch according to the present disclosure (also cf. FIG. 8). The opening central lever 7 includes a contact protrusion 71 adapted to be driven in abutment by the second protrusion 142 of the clutch/declutch intermediate lever 14 (not represented) projecting through the third oblong slot 153 which is not represented herein but rather in FIG. 7.

This is done so that the translational displacement of the transfer central lever 6 (not represented) is adapted to displace the second protrusion 142 of the clutch/declutch intermediate lever 14 between a position where the second protrusion 142 is unable to rotatably drive the opening central lever 7 illustrated in FIG. 20*a*, and a position where the rotation of the release lever 15 by the displacement device 21 (not represented herein but rather in FIGS. 1*c* and 7) causes the displacement of the opening central lever 7 by abutting contact with the contact protrusion 71 illustrated in FIG. 20*b*.

FIG. 21 shows the positioning of the driver E with the driving toothed wheel 2 and the driven wheel 5. It also shows the actuator Al and the release lever 15 in the second abutment intermediate position when the transfer central lever 6 has been lifted by the driver E.

It is important to highlight that this example is not limiting because the latch according to the present disclosure, in the form with the rocker lever 11, allows adopting three positions including the intermediate one which is a new start either again towards the first stop or towards the second stop thereby allowing for two functions.

Thus, at the intermediate abutment state, two functions are available, depending on whether the motor rotates in one direction or the other. In this instance, we have chosen two functions comprising electric opening (function F+) and mechanical unlocking via a cable/control-rod—whether external or internal—linked to the release lever 15 (function F−). Furthermore, the table of FIG. 23 indicates all options that are available with the latch according to the present disclosure.

In the latch according to the present disclosure, each time the function F+ is used, in the is instance the electric opening, the function F−, in this instance the mechanical unlocking of the opening via a cable, is reset. The return of the rocker lever 11 back in the angular position cleared with respect to the stroke of the transfer central lever 6 is achieved when the striker engages with the pin at the time of closing the door leaf including the latch according to the present disclosure. We talk about a "reset" function.

In the following description, reference is made to FIGS. 11 to 19.

Figure 11:
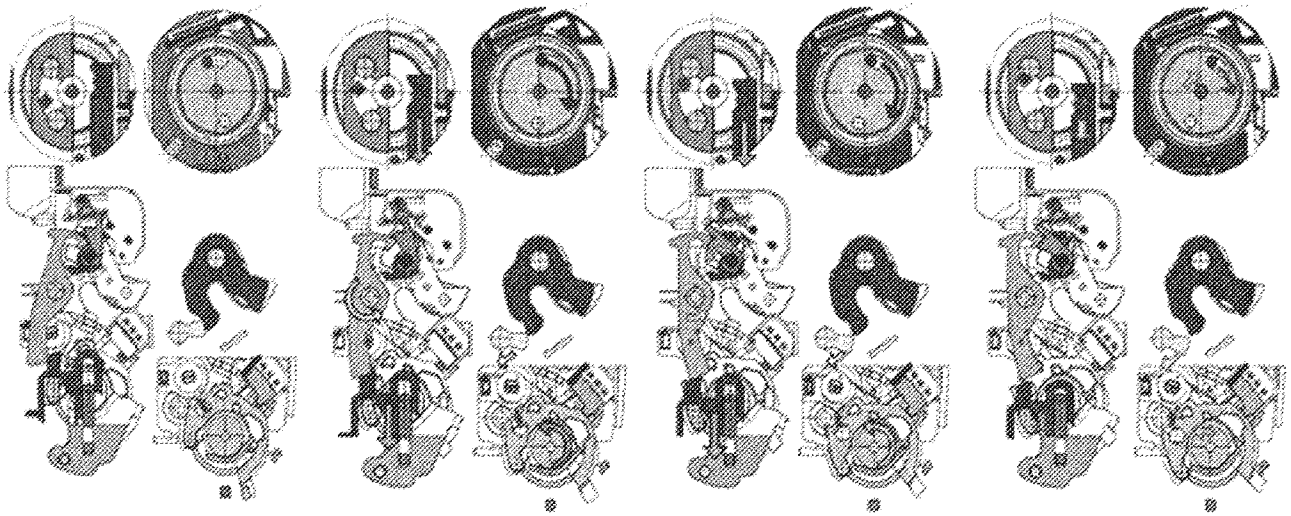
FIG. 11 illustrates the kinematics of the actuator of the latch, according to the present disclosure, during an electric opening towards a first stop position of the actuator.
Figure 12:
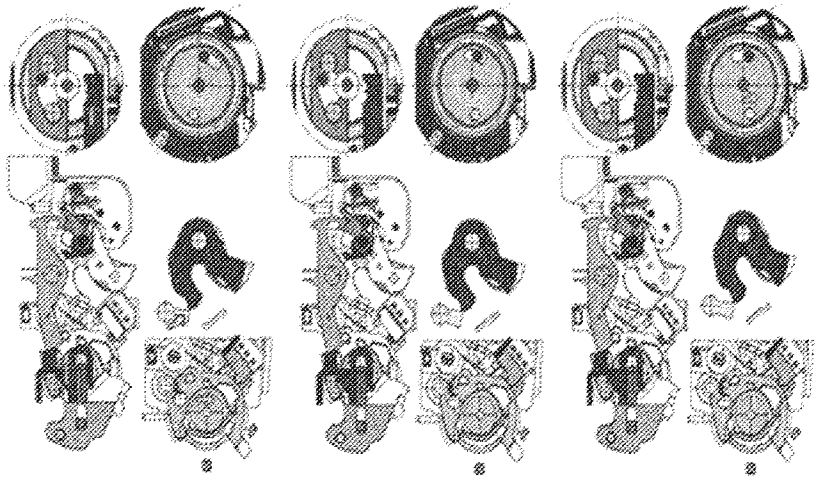
FIG. 12 illustrates the kinematics of the actuator of the latch, according to the present disclosure, during a return of the driving toothed wheel back in the initial position.

FIGS. 11 and 12 illustrate the kinematics of this motor-driven opening until stoppage and blocking of the transfer central lever in the position of blocking the transfer central lever 6 in the position of displacement of the pawl 9 in its stowed angular position. In this instance, the function F+ includes electric opening. At each step, the driver, as well as A1 an A2, are shown in both faces. The arrows show the generated displacements.

Thus, in FIG. 11 from left to right, the motor 1 actuates the driving toothed wheel 2 through a worm screw 3. The driving toothed wheel 2 rotatably drives the driven wheel 5 and therefore the crankpin 5*b*. The latter drives, without any backlash, a translation of the transfer central lever 6. The translation makes the opening central lever 7 rotates and transmits the movement to the first radial protrusion 91 of the pawl 9 in the reverse direction. It is also possible to refer to the opening central lever 7 as reverser. Thus, a rotation of the pawl towards a striker 19 (not represented) release position is obtained.

When the translation of the transfer central lever 6 reaches an activation stroke which is that enabling the rocker lever 11 to fit into the stop wall 62 (FIG. 9) by the effect of the biasing spring 11*s*. This stable state is maintained by the pawl 12 of the rocker lever 11 which inhibits any back rotation of the rocker lever 11. The pawl 12 of the rocker lever 11 is displaced thanks to its own biasing spring 12*s* which bias it towards its position of holding the rocker lever 11 in its angular position of blocking the transfer central lever 6. This stop position on the stop 16 is the first stable stop position.

In the kinematics of FIG. 12, from left to right, the crankpin 5*c* is first stopped on a stop 16 mounted in a stop device 18. After a determined delay time or a given senor-information, the actuator, and therefore the motor, is powered in the reverse direction. The transfer central lever 6 cannot return back in its initial top position because it is blocked by the rocker lever 11. The crankpin 5*a* is also blocked by the impossible rotation of the driven wheel secured to the transfer central lever 6. Nevertheless, because of the first circle-arc shaped oblong slot 41, the driving toothed wheel 2 continues rotating, and will stop later on the opposite side of the slot where the crankpin 5*a* lied at the beginning of FIG. 11.

Henceforth, it is possible to release a striker 19 (not represented) caught by the pin 10 since the pawl 9 is stabilized in the stowed position and therefore cleared with respect to a rotation of the pin 10.

Henceforth, the pin can pivot by the effect of its own biasing spring 10*s* or by the effect of the striker when pulling on the door. It can also remain in its striker catch position if the seal reaction is negative, for example when the car is parked at a determined angle or if the seals of the door are frozen.

The sequence that will be detailed later on describes the kinematics when the rotation of the pin is delayed by one of the phenomena hereinabove. It would have been identical if the pin 10 was driven in opening as soon as the electric opening was effective, at the end of the sequence of FIG. 11.

Following successively, from left to right, FIGS. 13, 14 and 15, it is shown that the pawl 12 of the rocker lever 11 inhibits the rocker lever 11 from leaving the angular position of blocking the transfer central lever 6, and that, throughout the entire rotation of the pin 10 towards the position of fully releasing the striker 19 (not represented). The radial surfaces 121 and 131 belonging respectively to the pawl 12 of the rocker lever 11 and to the pin touch-probe 13 successively serve as a bearing surface for the end 112*a* of the rocker lever 11 when the pin 10 is rotatably driven towards its striker 19 release angular position.

On completion of these kinematics shown in FIG. 14, the rocker lever 11 has remained in the angular position of blocking the transfer central lever 6 and the pawl 9 is still held in the stowed angular position.

Referring to FIGS. 16 and 16*a*, when the pin is rotatably driven inwardly by a striker 19 during a closure of the door leaf, the pin touch-probe 13 rotates clockwise and the end 112*a* of the rocker lever 11 inhibits the pawl 12 of the rocker lever from engaging again on the radial surface 121 of the pawl 12 (FIG. 16*a*).

To achieve that effect, the radius of the pawl 12 of the rocker lever 11 is larger than that of the pin touch-probe 13. Thus, the rocker lever 11 is brought towards a rest position illustrated at the end of the kinematics of FIG. 16. This releases the translation of the transfer central lever 6 towards its initial top position.

Referring to FIG. 17 to be read from left to right, the crankpin (5*b*) returns back to its initial position by cascade spring biasing from the opening central lever 7. The opening central lever 7 may also return back to its initial position, during this return stroke of the opening central lever 7, the pawl recovers its angular position of retaining the pin 10.

Throughout these kinematics of FIG. 17, the crankpin (5*a*) returns back to the other end of the first circle-arc shaped oblong slot 41, which corresponds exactly to the start point of the described actuator. This position is stabilized and it lies again in the second stable intermediate stop position.

At this level, the opening central lever 7 is free to return back to its angular position in which the pawl is adapted to cooperate in abutment with a sear 101 or 102 of the pin 10. Because of the pawl spring 9*s* (not represented), the pawl 9 is biased towards the angular position of retaining the pin 10. Blocking of the striker catch angular position is effective and the electric opening function, as well as another F-type function that will be described in the kinematics of FIGS. 18 and 19, are available again.

Thus, the latch according to the present disclosure is again in the intermediate stop state. Referring to FIG. 18, the motor 1 rotates in a direction opposite to that of the first electric opening function and the worm screw 3 makes the driving toothed wheel 2 and the crankpin 5*a* ends up being driven by abutment with the first circle-arc shaped oblong slot 41 so as to drive the driven wheel 5. The crankpin 5*b* of the driven wheel 5 will be displace the transfer central lever 6 in translation upwardly as illustrated at the end of FIG. 19.

Thus, the spring 14*s* securely displaced with the transfer central lever 6 will drive, with it in the same direction, by its leg 14*s*1, the clutch/declutch intermediate lever 14. This kinematics end when the crankpin 5*c* abuts on the stop 17. This is the third stable stop position of the latch according to the present disclosure.

At this level, the clutch/declutch intermediate lever 14 has been displaced from a declutched position into a clutched position (cf. FIG. 20*a*, 20*b*). Henceforth, the second protrusion 142 of the clutch/declutch intermediate lever 14 can drive the opening central lever 7 by its contact protrusion 71.

A mechanical opening operation by pulling on a handle linked to the interface set A2 will not have any mechanical effect on the transfer central lever 6.

Following the opening of the door leaf and therefore the rotation of the pin 10, when a striker is engaged again, the rocker lever 11 remains in the position cleared with respect to the stroke of the transfer central lever 6. The latter is in the stable top stop position and therefore the striker is caught, but a mechanical release (function F−) is still possible since the clutch/declutch intermediate lever 14 is in the clutched position (FIG. 20*b*).

Hence, the solution described in this example includes an electric opening (function F+) as well as a release lever 15 linked to a clutchable mechanical unlocking device (function F−). It should be noted that the later allows removal of an inertial system. Indeed, an acceleration created by an impact will not result in an inadvertent opening by driving of the handle.

Nonetheless, it is possible to clutch the external handle during a collision (function F−) so that access to the inside from outside—or vice versa or both—the vehicle is mechanically possible after a possible accident or impact.

It is possible to add another clutchable/declutchable lever similar to the release lever 15 and link the latter to the internal handle.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. An electric latch for a door leaf of a motor vehicle comprising:

a pin adapted to pivot about an axis of the pin between a striker catch angular position and a striker release position;

a pawl adapted to pivot about an axis of the pawl between a locking angular position in which the pawl is prone to cooperate in abutment with a sear of the pin to retain the pin in the striker catch angular position and a stowed angular position in which the pin is free to rotate about an axis of the pin;

an opening central lever, the opening central lever bearing on the pawl and adapted to displace the pawl in the stowed angular position; and an actuator configured to occupy three stop positions and adapted to cooperate with the opening central lever, the actuator comprising:

a driver comprising a driving toothed wheel and driven wheel, the driving toothed wheel being adapted to rotatably drive the driven wheel by a first drive member and the driven wheel including a second drive member, a motor configured to rotatably drive the driving toothed wheel of the driver by a worm screw; and a transfer central lever adapted to be displaced by the driven wheel of the driver by the second drive member and whose movement is adapted to be transmitted to the opening central lever to displace the pawl into the stowed angular position, wherein:

one amongst the driving toothed wheel and the driven wheel of the driver comprises a first circle-arc shaped oblong slot and the other one amongst the driving toothed wheel and the driven wheel of the driver comprises the first drive member extending through the first circle-arc shaped oblong slot, the driver being adapted to perform a rotating stroke of the one amongst the driving toothed wheel and the driven wheel of the driver without rotatably driving the other one amongst the driving toothed wheel and the driven wheel of the driver;

the electric latch comprises an interface set adapted to cooperate with the opening central lever to displace the pawl into the stowed angular position and including a release lever adapted to pivot about an axis of the release lever to displace the pawl between a pin retaining angular position and a striker release stowed position, the release lever including a linking device adapted to receive a displacement device for displacing the release lever comprising a cable and a control-rod;

the transfer central lever is adapted to be displaced by translation in a plane perpendicular to the axis of the release lever, the transfer central lever comprising a second oblong slot extending in the direction of translation of the transfer central lever;

the release lever comprises a third oblong slot extending in the direction of translation of the transfer central lever;

the electric latch further comprises a clutch and declutch intermediate lever between the transfer central lever and the release lever, the clutch and declutch intermediate lever including a first protrusion and a second protrusion extending substantially perpendicularly with respect to the plane of the lever, the first protrusion extending through the second oblong slot and the second protrusion projecting through the third oblong slot; and the opening central lever includes a contact protrusion adapted to be driven in abutment by the second protrusion projecting through the third oblong slot therefore the translational displacement of the transfer central lever is adapted to displace the second protrusion of the clutch and declutch intermediate lever between a position where a surface is unable to rotatably drive the opening central lever and a position where the rotation of the release lever by the displacement device causes the displacement of the opening central lever by abutting contact with the contact protrusion of the opening central lever.

2. The electric latch according to claim 1, wherein the first drive member is a crankpin belonging to the driven wheel and extending perpendicularly with respect to one of two main faces of the driven wheel through the first circle-arc shaped oblong slot of the driving toothed wheel, the crankpin being radially eccentric and the first circle-arc shaped oblong slot allowing for a rotating idle stroke of the driving toothed wheel before driving by bearing the driven wheel.

3. The electric latch according to claim 1, wherein the second drive member of the driven wheel is a crankpin extending perpendicularly through a recess having a shape matching with the transfer central lever to displace by bearing the transfer central lever, the crankpin being radially eccentric.

4. The electric latch according to claim 1, wherein the electric latch further comprises a case within which lies the driver and on which is fastened a stop device equipped with two stops, and in that one amongst the wheels of the driver comprises a stop axial protrusion adapted to rotatably move between the two stops between two positions called first and third stop positions.

5. The electric latch according to claim 1, wherein the transfer central lever further comprises an elastic biasing device of the clutch and declutch intermediate lever bearing on the first protrusion, the elastic biasing device being adapted to bias the clutch and declutch intermediate lever towards an initial position non-biased by the transfer central lever.

6. The electric latch according to claim 1, wherein the pawl comprises a first radial protrusion and a second radial protrusion extending over two distinct planes perpendicular to the axis of rotation of the pawl , the first radial protrusion having a surface adapted to be driven by the opening central lever and the second radial protrusion having a surface adapted to cooperate in abutment with the sear of the pin to retain the pin in the striker release position.

7. The electric latch according to claim 1, wherein the electric latch comprises one single motor.

8. An electric latch for a door leaf of a motor vehicle comprising:

a pin adapted to pivot about an axis of the pin between a striker catch angular position and a striker release position;

a pawl adapted to pivot about an axis of the pawl between a locking angular position in which the pawl is prone to cooperate in abutment with a sear of the pin to retain the pin in the striker catch angular position and a stowed angular position in which the pin is free to rotate about an axis of the pin;

an opening central lever, the opening central lever bearing on the pawl and adapted to displace the pawl in the stowed angular position; and an actuator configured to occupy three stop positions and adapted to cooperate with the opening central lever, the actuator comprising:

a driver comprising a driving toothed wheel and driven wheel, the driving toothed wheel being adapted to rotatably drive the driven wheel by a first drive member and the driven wheel including a second drive member, a motor configured to rotatably drive the driving toothed wheel of the driver by a worm screw; and a transfer central lever adapted to be displaced by the driven wheel of the driver by the second drive member and whose movement is adapted to be transmitted to the opening central lever to displace the pawl into the stowed angular position, wherein:

one amongst the driving toothed wheel and the driven wheel of the driver comprises a first circle-arc shaped oblong slot and the other one amongst the driving toothed wheel and the driven wheel of the driver comprises the first drive member extending through the first circle-arc shaped oblong slot, the driver being adapted to perform a rotating stroke of the one amongst the driving toothed wheel and the driven wheel of the driver without rotatably driving the other one amongst the driving toothed wheel and the driven wheel of the driver;

the electric latch comprises:

a rocker lever having two opposite arms, the rocker lever being adapted to pivot about an axis of the rocker lever;

the transfer central lever comprising a stop wall adapted to interface with a first arm of the rocker lever; and the rocker lever being adapted to pivot between an angular position in which the first arm comes into abutting contact with an active surface of the stop wall to block the transfer central lever in a position of displacement of the pawl in the stowed angular position, and an angular position cleared with respect to a stroke of the transfer central lever in which the first arm of the rocker lever is away from the stop wall to enable a return of the pawl back in the locking angular position; and the electric latch comprises an elastic biasing device of the rocker lever adapted to bias the rocker lever in the angular position of blocking the transfer central lever.

9. The electric latch according to claim 8, wherein the electric latch comprises:

a rocker lever pawl adapted to pivot about the same axis as the pin between: a position in which the rocker lever pawl holds the rocker lever in the angular position of blocking the transfer central lever in the position of displacement of the pawl in the stowed angular position, and a position which enables a return of the rocker lever in the angular position cleared with respect to the stroke of the transfer central lever;

an elastic biasing device of the rocker lever pawl adapted to bias the rocker lever pawl towards a position of holding the rocker lever in the angular position of blocking the transfer central lever;

a pin touch-probe adapted to pivot about the same axis as the pin, the pin touch-probe, and the pin being rotatably linked; and radial surfaces belonging respectively to the pawl of the rocker lever and to the pin touch-probe and one end of the rocker lever comprising the end of the rocker lever is adapted to rest successively on the radial surfaces when the pin is rotatably driven towards the striker release position.

10. The electric latch according to claim 9, wherein the pin touch-probe comprises a notch having a shape matching with the end of the rocker lever.

11. The electric latch according to claim 8, wherein the axes of rotation of the pin, of the pawl, of the release lever, and of the rocker lever are parallel to one another.

12. The electric latch according to claim 9, wherein a radius of the rocker lever pawl is larger than that of the pin touch-probe.

13. An electric latch for a door leaf of a motor vehicle comprising:

a pin adapted to pivot about an axis of the pin between a striker catch angular position and a striker release position;

a pawl adapted to pivot about an axis of the pawl between a locking angular position in which the pawl is prone to cooperate in abutment with a sear of the pin to retain the pin in the striker catch angular position and a stowed angular position in which the pin is free to rotate about an axis of the pin;

an opening central lever, the opening central lever bearing on the pawl and adapted to displace the pawl in the stowed angular position; and an actuator configured to occupy three stop positions and adapted to cooperate with the opening central lever, the actuator comprising:

a driver comprising a driving toothed wheel and driven wheel, the driving toothed wheel being adapted to rotatably drive the driven wheel by a first drive member and the driven wheel including a second drive member, a motor configured to rotatably drive the driving toothed wheel of the driver by a worm screw; and a transfer central lever adapted to be displaced by the driven wheel of the driver by the second drive member and whose movement is adapted to be transmitted to the opening central lever to displace the pawl into the stowed angular position, wherein:

one amongst the driving toothed wheel and the driven wheel of the driver comprises a first circle-arc shaped oblong slot and the other one amongst the driving toothed wheel and the driven wheel of the driver comprises the first drive member extending through the first circle-arc shaped oblong slot, the driver being adapted to perform a rotating stroke of the one amongst the driving toothed wheel and the driven wheel of the driver without rotatably driving the other one amongst the driving toothed wheel and the driven wheel of the driver;

the electric latch comprises:

a rocker lever having two opposite arms, the rocker lever being adapted to pivot about an axis of the rocker lever;

the transfer central lever comprising a stop wall adapted to interface with a first arm of the rocker lever; and the rocker lever being adapted to pivot between an angular position in which the first arm comes into abutting contact with an active surface of the stop wall to block the transfer central lever in a position of displacement of the pawl in the stowed angular position, and an angular position cleared with respect to a stroke of the transfer central lever in which the first arm of the rocker lever is away from the stop wall to enable a return of the pawl back in the locking angular position; and the actuator is adapted to occupy a first, a second, and a third stop positions:

the first stop position being defined by a contact of a stop axial protrusion on one of the stops when the motor rotates in one direction;

the second stop position being an intermediate position of the stop axial protrusion on a stop of the first circle-arc shaped oblong slot when the motor rotates in another direction; and the third stop position being defined by the contact of the stop axial protrusion on another stop.

* * * * *